US005674174A

United States Patent [19]

Carr

[11] Patent Number: 5,674,174

[45] Date of Patent: Oct. 7, 1997

[54] LOW-SHEAR FEEDING SYSTEM FOR USE WITH BOTTOM FEED CENTRIFUGES

[75] Inventor: Robert B. Carr, Brookline, Mass.

[73] Assignee: Carr Separations, Inc., Franklin, Mass.

[21] Appl. No.: 548,322

[22] Filed: Nov. 1, 1995

[51] Int. Cl.[6] ..... B04B 11/04

[52] U.S. Cl. ..... 494/65

[58] Field of Search ..... 494/5, 6, 23, 27, 494/43, 60, 62, 65, 80, 85; 210/360.2, 364, 365, 366, 367, 377, 380.1

[56] References Cited

U.S. PATENT DOCUMENTS

| | | | |
|---|---|---|---|
| 840,497 | 1/1907 | Kaehl | 494/65 |
| 1,018,878 | 2/1912 | Christensen | 494/65 X |
| 1,048,905 | 12/1912 | Sperry . | |
| 1,101,940 | 6/1914 | Kopke | 494/59 X |
| 1,119,174 | 12/1914 | Kopke | 494/59 X |
| 1,119,175 | 12/1914 | Kopke | 494/65 X |
| 1,224,164 | 5/1917 | Hamill | 494/65 |
| 1,279,057 | 9/1918 | Weston | 494/65 X |
| 1,400,622 | 12/1921 | Nordell . | |
| 1,401,196 | 12/1921 | Sharples | 494/65 X |
| 1,896,180 | 2/1933 | Lindequist | 494/65 X |
| 2,083,809 | 6/1937 | Asch . | |
| 2,156,253 | 4/1939 | Clarke | 494/65 X |
| 2,593,294 | 4/1952 | Goldberg . | |
| 2,720,358 | 10/1955 | Silk | 494/65 |
| 2,785,765 | 3/1957 | Cornell . | |
| 2,788,937 | 4/1957 | Weiland | 494/65 X |
| 2,887,267 | 5/1959 | DeLangen . | |
| 3,007,629 | 11/1961 | Boyland . | |
| 3,023,949 | 3/1962 | Bankerd . | |
| 3,327,401 | 6/1967 | Stamos et al. . | |
| 3,989,185 | 11/1976 | Mercier . | |
| 4,030,897 | 6/1977 | Pelzer et al. . | |
| 4,371,382 | 2/1983 | Ross . | |
| 4,406,651 | 9/1983 | Dudrey et al. | 494/65 X |
| 4,517,091 | 5/1985 | Yamanaka et al. | 210/512.1 |
| 5,203,999 | 4/1993 | Hugues | 210/512.3 |
| 5,227,061 | 7/1993 | Bedsole | 210/304 |

FOREIGN PATENT DOCUMENTS

| | | | |
|---|---|---|---|
| 551182 | 1/1958 | Canada . | |
| 92225 | 6/1897 | Germany | 494/65 |
| 2155366 | 9/1985 | United Kingdom . | |

*Primary Examiner*—Charles E. Cooley
*Attorney, Agent, or Firm*—Darby & Darby

[57] ABSTRACT

A centrifugal separator for separating the solids component of a feed liquid comprises a bowl that is rotatable about a vertically disposed axis. The bowl has an interior wall, a conical lower end and a generally cylindrical portion. The conical lower end includes a central opening and defines a lower edge which has a first diameter and an upper edge which has a second greater diameter. A fluid applicator that is moveable between a stowed position and an application position may apply the feed liquid to the interior wall adjacent to the lower edge of the conical lower end so that as the bowl rotates, the angular velocity of the feed liquid gradually and non-traumatically increases, gently forcing the feed liquid upwards along the wall of the conical lower end and into the generally cylindrical portion of the bowl.

2 Claims, 4 Drawing Sheets

LOW-SHEAR FEEDING SYSTEM FOR USE WITH BOTTOM FEED CENTRIFUGES

FIELD OF THE INVENTION

This invention generally relates to centrifuges, and more particularly, to feeding systems used in centrifuges to introduce a liquid suspension into a separation bowl.

BACKGROUND OF THE INVENTION

Centrifugal separators include a bowl adapted to rotate and separate the components of a liquid suspension (or feed liquid) according to their different specific gravities, generally resulting in a dense solids cake compressed tightly against the wall surface of the bowl, and a less-dense pool of clarified liquid located radially inward of the solids cake. As the bowl rotates, both the solids cake and the pool of clarified liquid rotate at approximately the rotational speed of the bowl.

During typical prior art separation processes, the feed liquid is introduced into an already rotating bowl. Many commercial centrifuges, (such as solid bowl basket type) introduce the feed liquid by feeding directly onto the rotating liquid pool. This causes a high level of turbulence in the pool which reduces the separating efficiency and the degree of liquid clarification.

Other centrifuges (such as decanter, tube bowl and disc stack), introduce the feed liquid through mechanical feed distributors which commonly include vanes, flutes, ridges, or other mechanisms that provide rapid and positive acceleration of the feed stream in the shortest possible time. The high rate of acceleration imposed on the feed liquid introduces a point of high shear to the feed which can damage fragile liquids and solids even prior to their separation.

Frequently, the feed mechanisms of these prior art devices require that the liquid pass through one of several small diameter holes in the bowl. As the liquid passes through these holes, it is accelerated, almost instantly, from a relatively slow rotational flow to the angular velocity of the surface (most radially inward) of the liquid pool. It is at this point of acceleration where high shear forces are applied to the liquid. The high shear forces can easily destroy an unacceptable percentage of the solid component of the liquid feed prior to separation.

In other prior separation devices, such as decanters and tube bowl separators, the feed liquid is required to jump an air gap from the feed distributor to the liquid pool. As in the other prior art devices, this type of feed mechanism introduces the feed liquid to the liquid pool in a traumatic manner which again creates both high shear and turbulence at the point of impact.

It is therefore an object of the invention to provide a feed mechanism for use with centrifugal separators which overcomes the deficiencies of the prior art.

It is another object of the invention to provide such a feed mechanism which introduces liquid feed to a rotating liquid pool within a rotating bowl of a centrifugal separator without exerting high shear forces to the liquid feed.

SUMMARY OF THE INVENTION

A centrifugal separator for separating the solids component of a feed liquid comprises a bowl that is rotatable about a vertically disposed axis. The bowl has an interior wall, a conical lower end and a generally cylindrical portion. The conical lower end includes a central opening and defines a lower edge which has a first diameter and an upper edge which has a second greater diameter. A fluid applicator applies the feed liquid to the interior wall adjacent to the lower edge of the conical lower end so that as the bowl rotates, the angular velocity of the feed liquid gradually and non-traumatically increases, gently forcing the feed liquid upwards along the wall of the conical lower end and into the generally cylindrical portion of the bowl.

DETAILED DESCRIPTION OF THE PREFERRED EMBODIMENT

Figure 1:
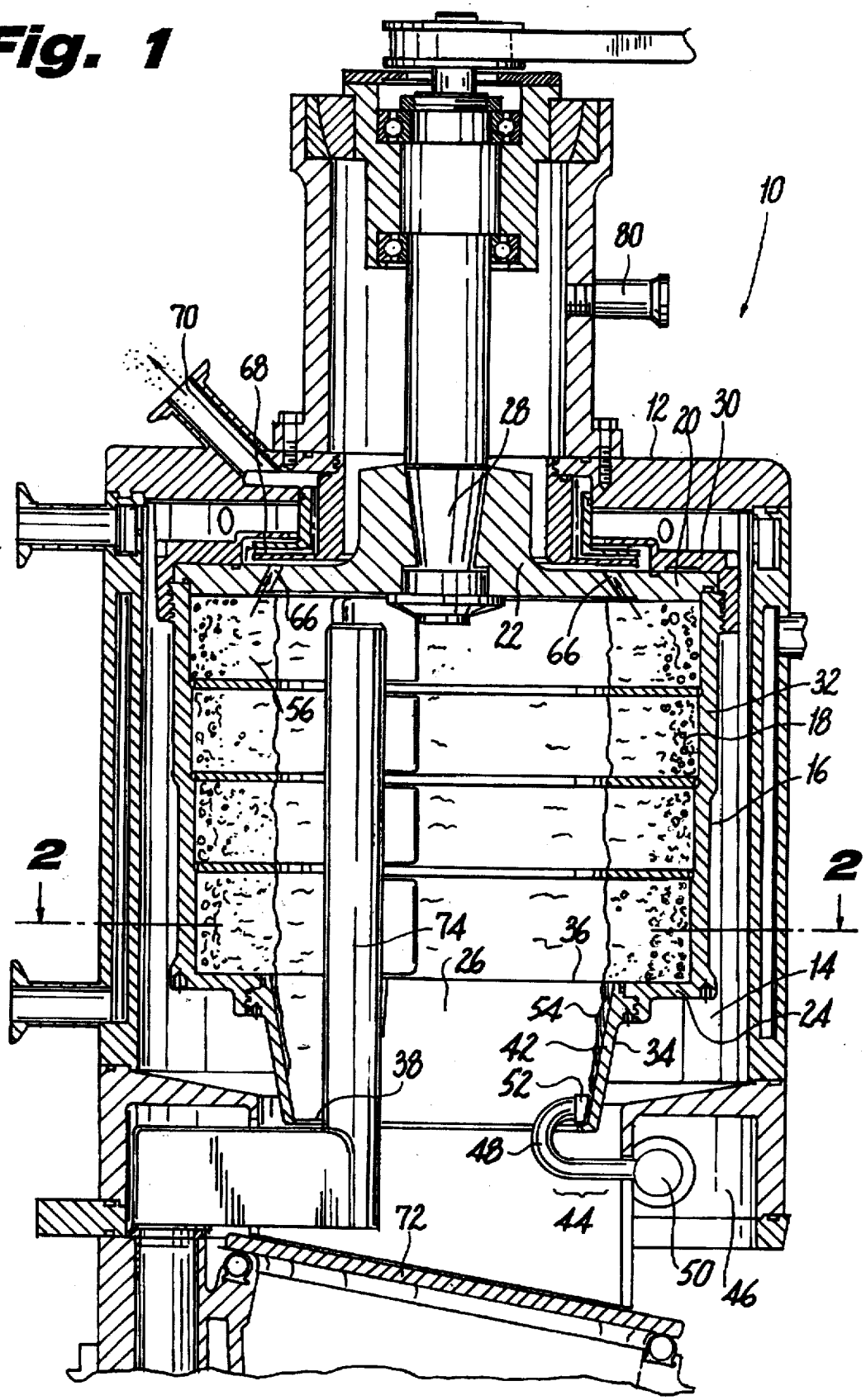
FIG. 1 is a sectional view of a centrifugal separator, in accordance with the invention, showing details of a scraper assembly, a washing sprayer, a feed applicator, and a feed distributor, during a feed mode of a separation cycle.

Referring to FIG. 1, a centrifugal separator 10 is shown, in accordance with the invention, including a housing 12 with a separation chamber 14, and a bowl 16. The bowl 16 is rotatably supported within the separation chamber 14 and includes a generally cylindrical wall 18, an upper end plate 20 having an integrally formed connecting hub 22, and a lower end plate 24 having a central opening 26. The connecting hub 22 is adapted to be connected to a drive shaft 28, which is driven by a motor (not shown). The upper end plate 20 is circular and adapted to be attached to the upper rim of the cylindrical wall 18, by a threaded end cap 30 whose threads engage mating threads formed along an outer surface 32 of the cylindrical wall 18.

The lower end plate 24 is similarly disc shaped having a circular outside peripheral edge which is preferably integrally formed with the lower edge of the cylindrical wall 18. The end plate 24 includes an inside peripheral edge 32 which defines the central opening 26 and which is preferably threaded. A feed distributor cone 34 is attached to the lower end plate 24 with mating threads located along an upper edge 36 of the wide-diameter end of the cone 34. The feed distributor cone 34, as shown in FIGS. 1 and 3–5, includes a lower circular edge 38 which defines a discharge opening 40 and a smooth wall surface 42.

Figure 2:
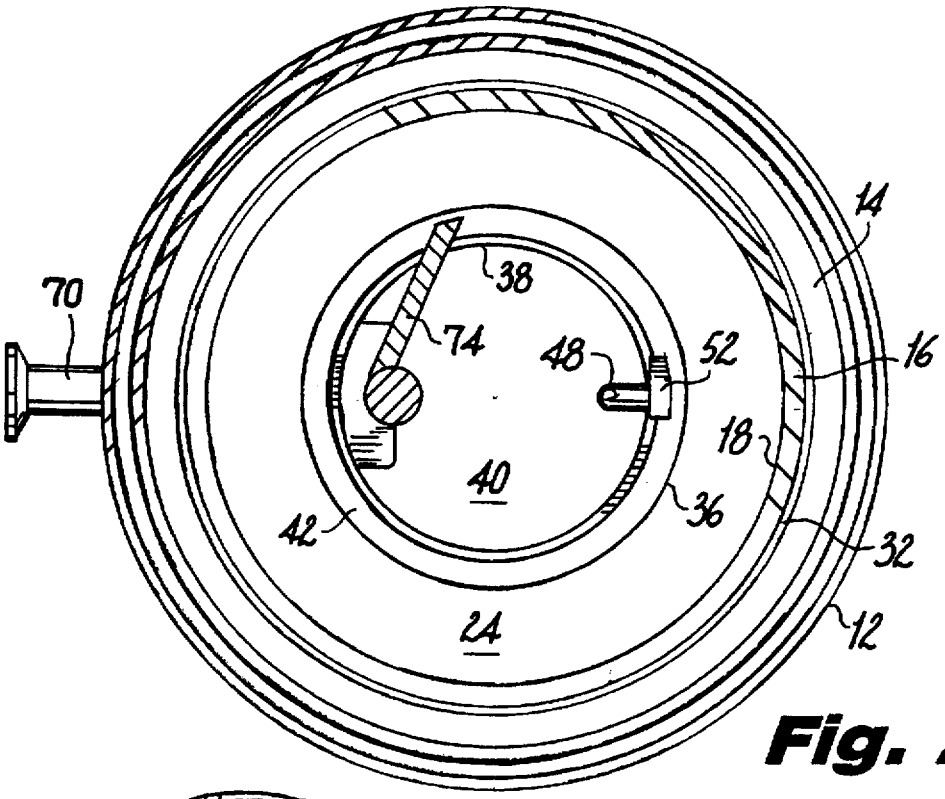
FIG. 2 is a top sectional view of the centrifugal separator, taken along the lines 2—2 of FIG. 1, in accordance with the invention.
Figure 3:
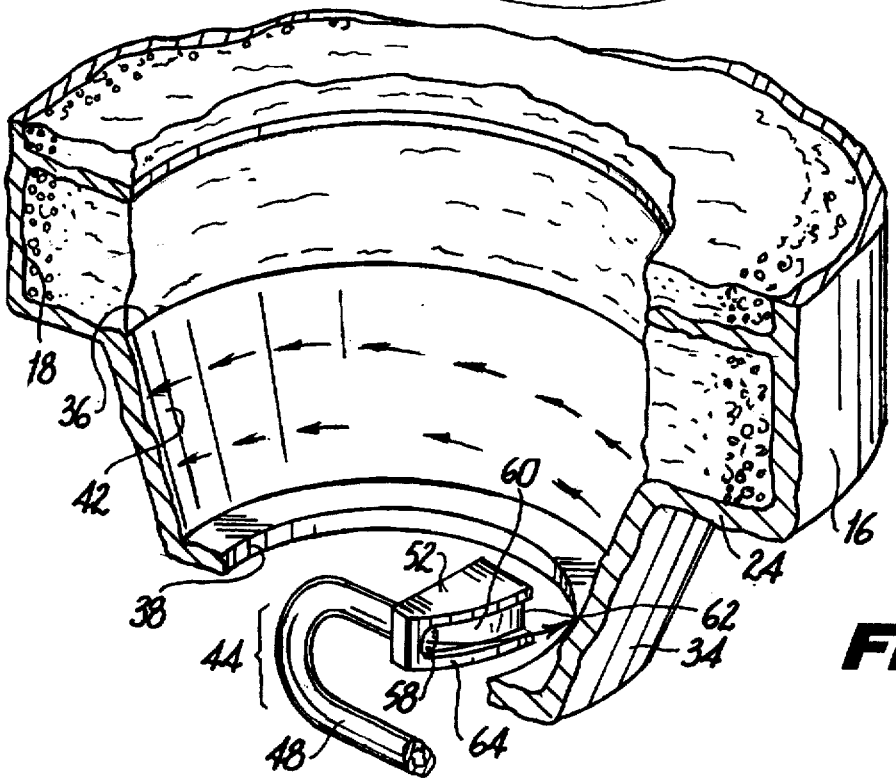
FIG. 3 is a sectional perspective view of a portion of the centrifugal separator of FIG. 1, showing details of the feed distributor and the feed applicator, during the feed mode and in accordance with the invention.

A feed applicator assembly 44 is pivotally mounted to the housing 12 within cavity 46 and includes a feed tube 48, a pivotal fluid coupling 50 and an applicator head 52. The feed applicator assembly 44 is adapted to be selectively pivoted between a stowed position located within the cavity 46, shown in FIGS. 4 and 5, and an application position wherein the applicator head 52 is positioned through the discharge opening 40 and immediately adjacent to the wall surface 42, as shown in FIGS. 1, 2 and 3.

In accordance with the invention, the purpose of the feed applicator assembly 44 and the feed distributor cone 34 is to minimize trauma to the liquid feed 54, by allowing the angular velocity of the applied liquid feed 54 to gradually increase up to the angular velocity of the liquid pool 56 located in the bowl 16. The feed liquid 52 is applied to the smooth wall surface 42 of the feed distributor cone 34 adjacent the lower edge 38. Owing to the smaller-diameter of the lower edge 38 of the distributor cone 34, the angular velocity of the wall surface 42 at the lower edge 38 is less than the angular velocity of the upper edge 36 of the cone 34 and is also less than the angular velocity of the surface of the liquid pool 56 within the bowl 16. Once applied, the liquid feed 54, as shown in FIG. 3, slowly accelerates and rises, in a somewhat spiral path, along the wall surface 42 of the distributor cone 34, until it reaches and combines with the liquid pool with equal (or near equal) angular velocities.

The applicator head 52 preferably includes an inlet 58, a channel 60, and an outlet 62. The head 52 preferably includes an outer surface 64 which has a portion (adjacent to the outlet 62) which is shaped similar to the curvature and vertical angle of the distributor cone 34. The channel 60 which is formed into the outer surface 64 and connects the inlet 58 with the outlet 62 is adapted to not interfere with adjacent moving liquid feed. The inlet 58 is connected to the feed tube 48 so that any liquid feed 54 that is forced through the feed tube 48 will pass through the inlet 58 of the applicator head 52 and into the channel 60. The newly applied liquid feed located within the channel 60 will interact with the adjacent moving feed located along the wall surface 42 of the distributor cone 34 and will accelerate smoothly within the channel 60 and out through the outlet 62 to make the transition from the feed tube 48 (zero angular velocity) to the angular velocity of the adjacent feed liquid located on the wall surface 42 of the distributor cone 34.

The feed liquid is effectively "painted" by the applicator head 52 onto the smooth rotating wall surface 42 of the distribution cone 34 and thereby greatly reduces the "trauma" from the high shear forces experienced by the solids component of the feed liquid during injection into the rotating bowls of the prior art centrifugal separators. The separator 10 of the present invention preferably operates with the surface of the liquid pool located at either the upper edge 36 of the distributor cone 34 as shown in FIGS. 1 and 3 or against the wall surface 42 of the distributor cone 34 (between the upper and lower edges of the cone). With the operating liquid pool 56 rotating against the wall surface 42 of the cone 34 or adjacent to its upper edge 36, the feed liquid 54 may more gently combine with the liquid pool 56 without trauma.

By gently accelerating the feed liquid 54 up to the angular velocity of the surface of the liquid pool 56 inside the bowl 16, using the distributor cone 34 and the applicator head 52, the centrifugal separator 10 may efficiently process shear sensitive fluids or fluids containing fragile solids such as whole cells or flocculants, and any fluids that tend to foam or froth.

As the feed liquid 54 is continuously introduced into the rotating bowl 16 along the smooth wall surface 42 of the distributor cone 34, the portion of the feed liquid making up the liquid pool 56 already in the bowl 16 is rotating at a high angular velocity and its solid components are being influenced by centrifugal forces as high as 20,000 G's (gravities). These centrifugal forces pull the solids out of the liquid pool and compress them against the wall surface 18 of the bowl 16, leaving a clarified liquid pool 56 near the upper end plate 20 within the bowl 16. Due to a slightly upwardly directed conical shape of the wall surface of the bowl 16, the liquid pool is gradually forced upwardly towards the upper end plate 20 as the bowl rotates. The upper end plate 20 includes openings 66 which are positioned within the now clarified liquid pool. The clarified liquid pool 56 is continuously removed from the bowl 16 through the openings 66, at a rate equal to the rate of feed liquid application, with any appropriate method, but preferably using a centripetal pump 68 located between the end cap 30 and the upper end plate 20. The clarified liquid pool is pumped from the separator 10 through appropriate conduits 70 to a remote location (not shown).

In operation, the bowl 16 of the separator 10 is rotated at a predetermined speed. The feed applicator assembly 44 is pivoted about the pivotal fluid coupling 50 so that it pivots from its stowed position within the cavity 46 to its application position with the applicator head 52 located adjacent to the wall surface 42 of the distributor cone 34, as shown in FIGS. 1 and 3. A feed liquid 54 is forced through the feed tube 48 to the application head 52 and into a channel 60 from an inlet 58. The feed liquid 54 is directed to flow within the channel 60 in the direction of rotation of the bowl 16 and the distributor cone 34. The feed liquid 54 leaves the channel 60 of the applicator head 52 at the outlet 62, preferably at the same angular velocity as that of the adjacent wall surface 42 of the distributor cone 34, and is directed to flow against the rotating wall surface 42. The transition from the applicator head 52 and the wall surface 42 is smooth and in a manner which minimizes turbulence.

Once the feed liquid 54 is applied to the wall surface 42 and rotates, it is influenced by a centrifugal force which, owing to the upwardly directed distributor cone 34, slowly forces the feed liquid upwardly along the wall surface 42. As the feed liquid rises in response to the centrifugal force, the effective diameter of the wall surface 42 increases and, therefore, so does the angular velocity and the magnitude of the centrifugal force. The result is that the feed liquid 54 gradually and gently rotates with greater angular velocity and spirals against the wall surface 42 upwards towards the surface of the bowl 16, as illustrated by the arrows of FIG. 3.

A liquid pool 56 has been established within the bowl 16 and has a surface which contacts the lower end plate 24 at the peripheral edge of the central opening 26, as shown in FIG. 3, or the wall surface 42 of the distributor cone 34. In either case, the transition between the conical wall surface 42 and the surface of the liquid pool 56 is smooth and gradual so that the feed liquid may merge into the liquid pool 56 with an equal (or close to equal) angular velocity to that of the liquid pool 56. The smooth transition of the feed liquid into the liquid pool 56 generates low (or effectively no) shear forces and leaves the liquid pool 56 free of undesirable turbulence.

As the liquid pool 56 rotates within the bowl 16, centrifugal forces separate out its solid components and compacts them against the wall 18 of the bowl 16. The result is a clarified liquid pool 56 located at the top of the bowl 16, adjacent the upper end plate 20. The clarified liquid 56 is removed from the bowl 16 through the openings 66 and removed from the separator 10 by a centripetal pump 68 and appropriate conduit 70, as is appreciated by those skilled in the art.

Once a predetermined amount of solids cake is collected against the wall 18 of the bowl 16, the flow of feed liquid 54 through the feed tube 48 is stopped and the feed applicator assembly 44 is pivoted about the pivotal fluid coupling 50 to its stowed position within the cavity, as the system begins a drain mode followed by a discharge mode.

When the feed applicator assembly 44 is within the cavity 46, the bowl 16 is slowly slowed down and gently stopped.

Figure 4:
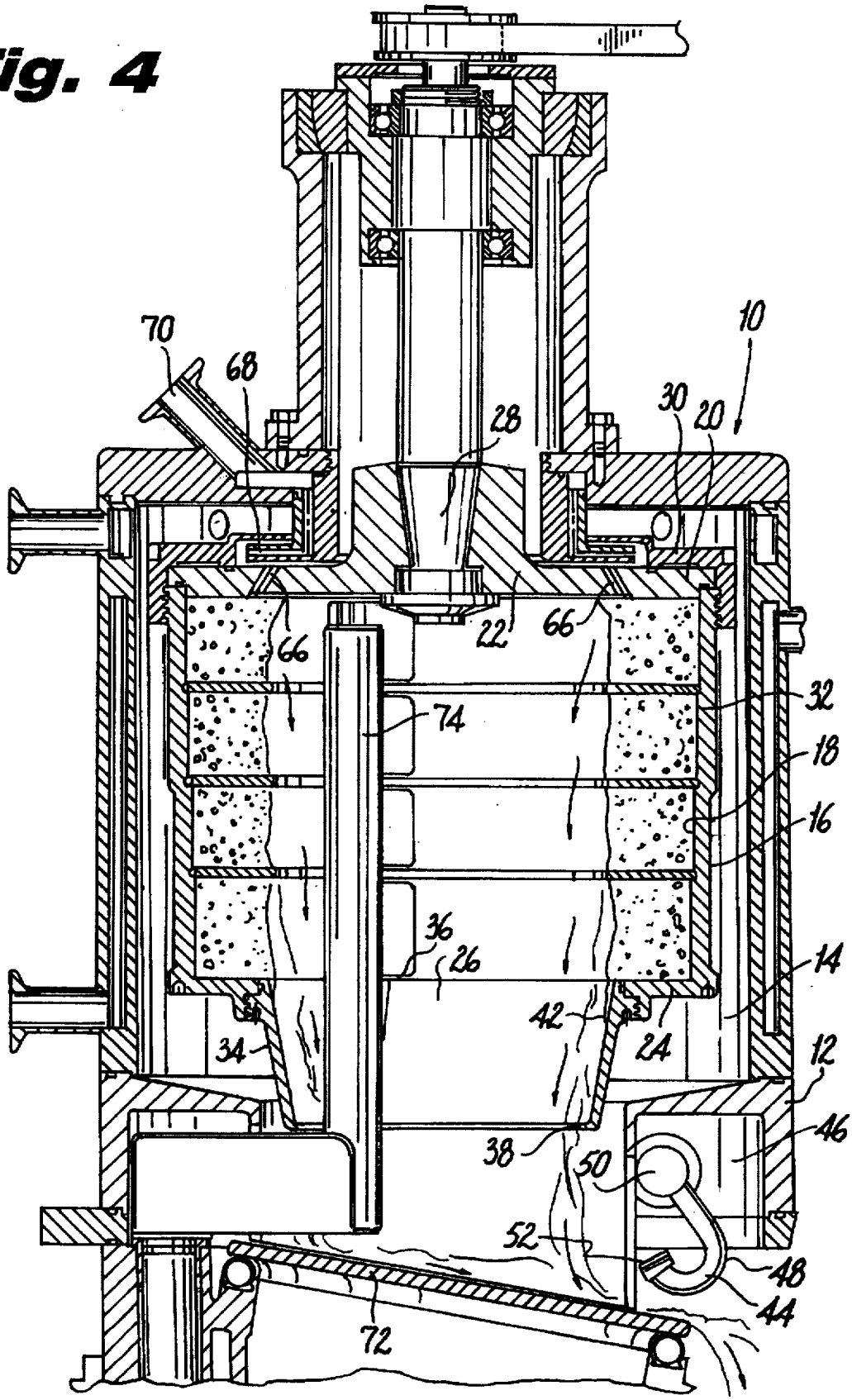
FIG. 4 is a sectional view of the centrifugal separator of FIG. 1, showing the relative position of the feed applicator during a drain mode, in accordance with the invention.
Figure 5:
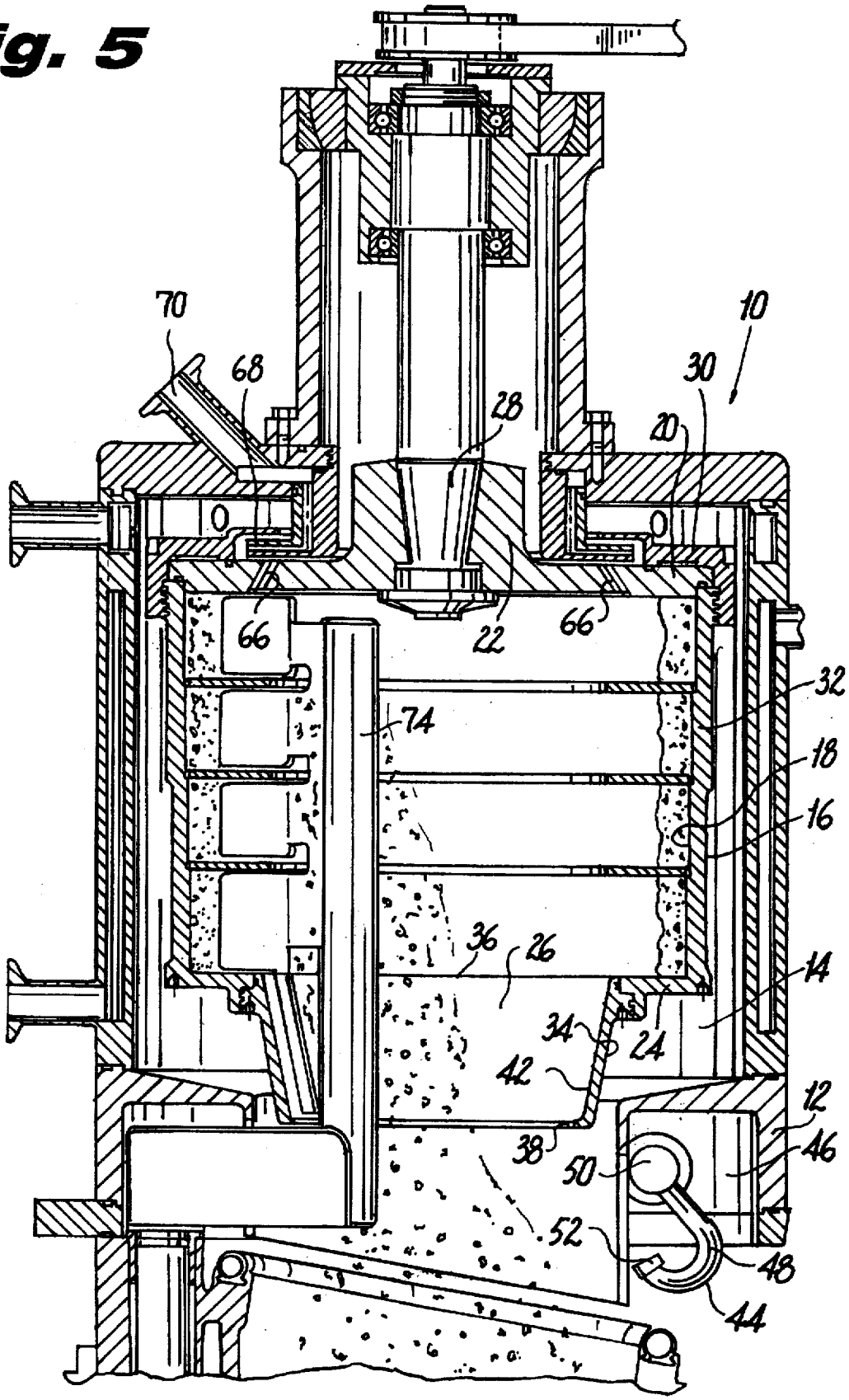
FIG. 5 is a sectional view of the centrifugal separator of FIG. 1, showing the relative position of the feed applicator during a discharge mode, in accordance with the invention.

As the bowl slows its rotation, the residual liquid remaining in the bowl 16 drains through the discharge opening 40, against a solids gate 72 (which is closed) and handled appropriately thereafter, as shown in FIG. 4, as understood by those skilled in the art.

Once the drain mode is complete and an acceptable amount of residual liquid has been removed from the solids cake, the solids gate 72 is moved to an open position and an appropriate scraper assembly 74 is advanced towards the wall 18 to remove the solids from the bowl 16. The dislodged solids fall through the discharge opening 40, past the solids gate 72 and are collected appropriately, as desired.

During the drain and discharge modes of operation, the feed applicator assembly 44 remains within the cavity 46, protected from any passing solids cake or liquid.

By removing the clarified liquid from the upper end plate 20, above and remote from where the solids cake forms within the bowl 16, the openings 66 are not at risk of clogging or contamination during the drain and discharge modes of operation, as are the clean-liquid discharge openings of prior art separators which are typically located at the bottom of the bowl, below the collected solids.

Other embodiments will occur to those skilled in the art and are within the scope of the following claims:

What is claimed is:

1. A centrifugal separator for separating the solids component of a feed liquid, comprising:

a bowl being rotatable about a vertically disposed axis and having a conical lower end and a generally cylindrical portion connected to and disposed above said conical lower end, said conical lower end including a central opening and defining a lower edge having a first diameter and an upper edge having a second greater diameter, said bowl having an interior wall; and a fluid applicator that is moveable between a stowed position exterior to said bowl and an application position for applying said feed liquid to said interior wall adjacent to said lower edge of said conical lower end, so that as said bowl rotates, the angular velocity of said feed liquid gradually and non-traumatically increases, gently forcing said feed liquid upwards along said wall of said conical lower end and into said generally cylindrical portion of said bowl.

2. The centrifugal separator in accordance with claim 1, wherein said fluid applicator pivots between said stowed position and said application position.

* * * * *